United States Patent [19]

Stockner et al.

[11] 4,267,977

[45] May 19, 1981

[54] TEMPERATURE CONTROLLED UNIT INJECTOR

[75] Inventors: Alan R. Stockner, Chillicothe; Michael K. Stratton, Peoria, both of Ill.

[73] Assignee: Caterpillar Tractor Co., Peoria, Ill.

[21] Appl. No.: 85,341

[22] PCT Filed: Jun. 4, 1979

[86] PCT No.: PCT/US79/00382

§ 371 Date: Jun. 4, 1981

§ 102(e) Date: Jun. 4, 1981

[87] PCT Pub. No.: WO80/02654

PCT Pub. Date: Dec. 11, 1980

[51] Int. Cl.[3] ..... B05B 15/00

[52] U.S. Cl. ..... 239/132.3

[58] Field of Search ..... 239/124, 125, 132, 132.1, 239/132.3, 132.5, 134, 135, 533.3, 533.4, 533.9; 123/41.31

[56] References Cited

U.S. PATENT DOCUMENTS

| | | | |
|---|---|---|---|
| 1,333,612 | 3/1920 | Fisher | 239/124 X |
| 1,860,063 | 5/1932 | Tobler | 239/132.3 X |
| 1,879,985 | 9/1932 | Lummen | 239/132.3 |
| 1,885,004 | 10/1932 | Crumbaker | 239/132.3 |
| 2,425,229 | 8/1947 | Bremser | 239/132.3 |
| 2,556,356 | 6/1951 | Alfaro et al. | 239/132.3 X |
| 3,398,895 | 8/1968 | Claffey | 239/132.3 |
| 3,460,760 | 8/1969 | Bluhm | 239/132.3 |

FOREIGN PATENT DOCUMENTS

| | | | |
|---|---|---|---|
| 503432 | 4/1939 | United Kingdom | 239/132.3 |
| 720916 | 12/1954 | United Kingdom | 239/132.3 |

*Primary Examiner*—Johnny D. Cherry
*Attorney, Agent, or Firm*—Charles E. Lanchantin, Jr.

[57] ABSTRACT

Fuel injectors operate in a high temperature environment associated with fuel combustion. Temperature control of the nozzle end of fuel injectors is advantageous. An improvement is provided in controlling the temperature of a fuel injector (12) adjacent the nozzle end (36) by conducting fluid toward and away from the nozzle end (36) by way of passages (52,54) formed in a retainer sleeve (48) associated with the fuel injector (12).

10 Claims, 5 Drawing Figures

TEMPERATURE CONTROLLED UNIT INJECTOR

DESCRIPTION

1. Technical Field

This invention relates generally to internal combustion engines and more particularly to temperature control in oil engines having forced oil supply.

2. Background Art

The nozzle or tip end of a unit fuel injection device is adjacent the combustion area of a cylinder and is therefore exposed to operate in a high temperature environment. Temperature control of the tip or nozzle end usually involves the use of fluids and maintaining control is advantageous to assure proper functioning of the fuel injector. One problem in providing proper temperature control is moving a sufficient amount of fluid to assure adequate temperature control. Obviously, the greater the volume of fluid moved, the greater the temperature controlling effect.

Supplying a greater volume of fluid involves enlarged fluid passageways. These passageways are usually provided in the various parts of a unit injector housed in a retainer sleeve. During assembly of these parts, time-consuming care must be taken to properly align the passageways. Enlarged passageways require additional space which results in a need to enlarge the unit injector and, since space is critically limited, it is difficult to provide adequately enlarged passageways.

In view of the above, it would be advantageous to provide a unit injector which provides adequate temperature control, avoids excessive use of critical space, avoids time-consuming assembly problems, and which overcomes the problems associated with the prior art.

DISCLOSURE OF INVENTION

In one aspect of the present invention, the problems pertaining to the known prior art, as set forth above, are advantageously avoided.

This is accomplished by providing a temperature controlled unit fuel injector including a retainer sleeve having a nozzle end and means for conducting fluid toward and away from the nozzle end. Fluid is conducted into a circumferential groove cooperating with an axial passage for moving fluid adjacent the nozzle end of the fuel injector. The circumferential groove and the axial passage are formed in the outer peripheral surface of the retainer.

The foregoing and other advantages will become apparent from the following detailed description of the invention when considered in conjunction with the accompanying drawings. It is to be expressly understood, however, that the drawings are not intended as a definition of the invention but are for the purpose of illustration only.

BEST MODE FOR CARRYING OUT THE INVENTION

Figure 1:
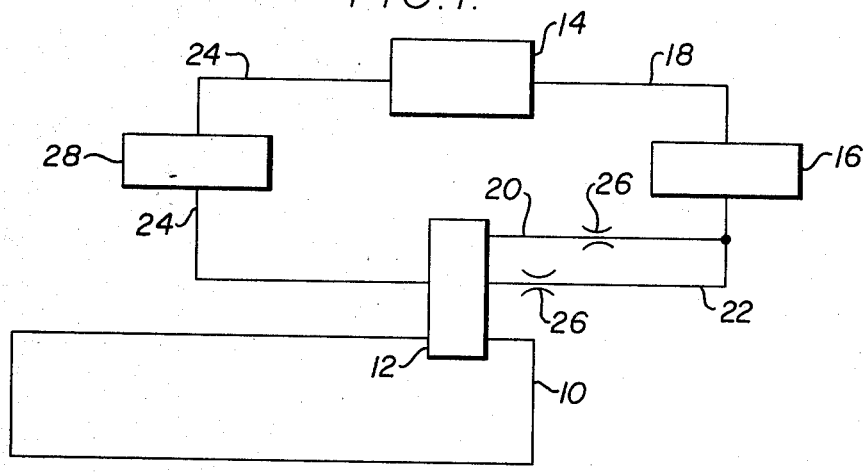
FIG. 1 is a graphic view illustrating a portion of a fuel injection system.

Referring now to FIG. 1, a portion of a fuel injection system is graphically represented including an engine 10 having one of several unit injectors 12 mounted therein adjacent a respective cylinder (not shown) of engine 10. To establish a reference cycle, a tank 14 supplies fluid such as fuel to a transfer pump 16 via an appropriate conduit 18. Pump 16 supplies fuel to fuel injector 12 at a substantially low pressure.

Some of the fuel from pump 16 is directed, via conduit 20, to fuel injector 12 to be injected into the respective cylinder. Other of the fuel from pump 16 is directed to fuel injector 12, via conduit 22, as a temperature controlling fluid, in this instance for cooling injector 12. The cooling fuel is then directed from injector 12 back to tank 14 via conduit 24 for further cooling substantially to ambient temperature and the cycle is repeated.

If the output of pump 16 is at too great a rate, optional flow resistors 26 may be used in either or both conduits 20,22 to control the fuel flow between pump 16 and injector 12.

A medium other than fuel may be used for cooling; however, such would require an additional tank, pump and additional conduits. An element such as a heat exchanger 28 may be used to supplement cooling.

Figure 2:
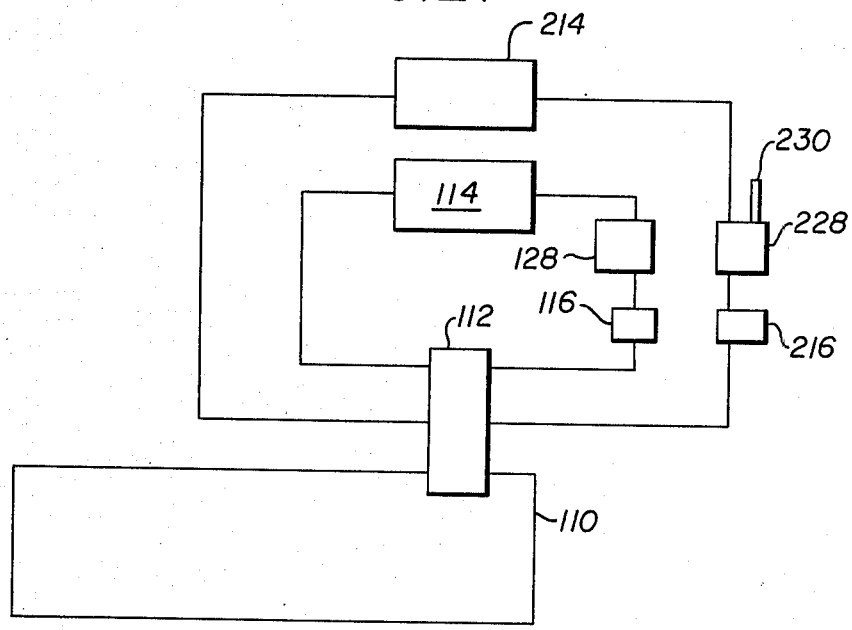
FIG. 2 is a graphic view illustrating a portion of an alternative fuel injection system.

As an alternative, FIG. 2 graphically illustrates that a fluid may be supplied to heat the fuel injector 112 in some instances. A system is anticipated including an engine 110 having one of several unit fuel injectors 112 mounted therein adjacent a respective cylinder (not shown) of engine 110. Such an engine may use a thicker, more viscous residual type fuel stored in tank 114. Such fuels could be heated by a supplemental element such as a heat exchanger 128 to thin or reduce the viscosity of the fuel. The fuel could then be supplied to injector 112 by pump 116. In this situation cooling of the tip is of increased importance.

A separate fluid could be stored in tank 214, cooled by a heat exchanger 228 and supplied to injector 112 by an alternate pump 216. This separate fluid could be conventional fuel or some other fluid and could be used to supply cooling or in some instances to supply heat to injector 112 by some arrangement such as, for example, injecting steam into heat exchanger 228, on command, by actuating a valve 230. Presence of a heated fluid in injector 112 could avoid congealing of the residual fuel in the event of a rapid shutdown of engine 110 occurring without an opportunity to purge the unit injector of high viscosity fuel prior to shutdown.

Figure 3:
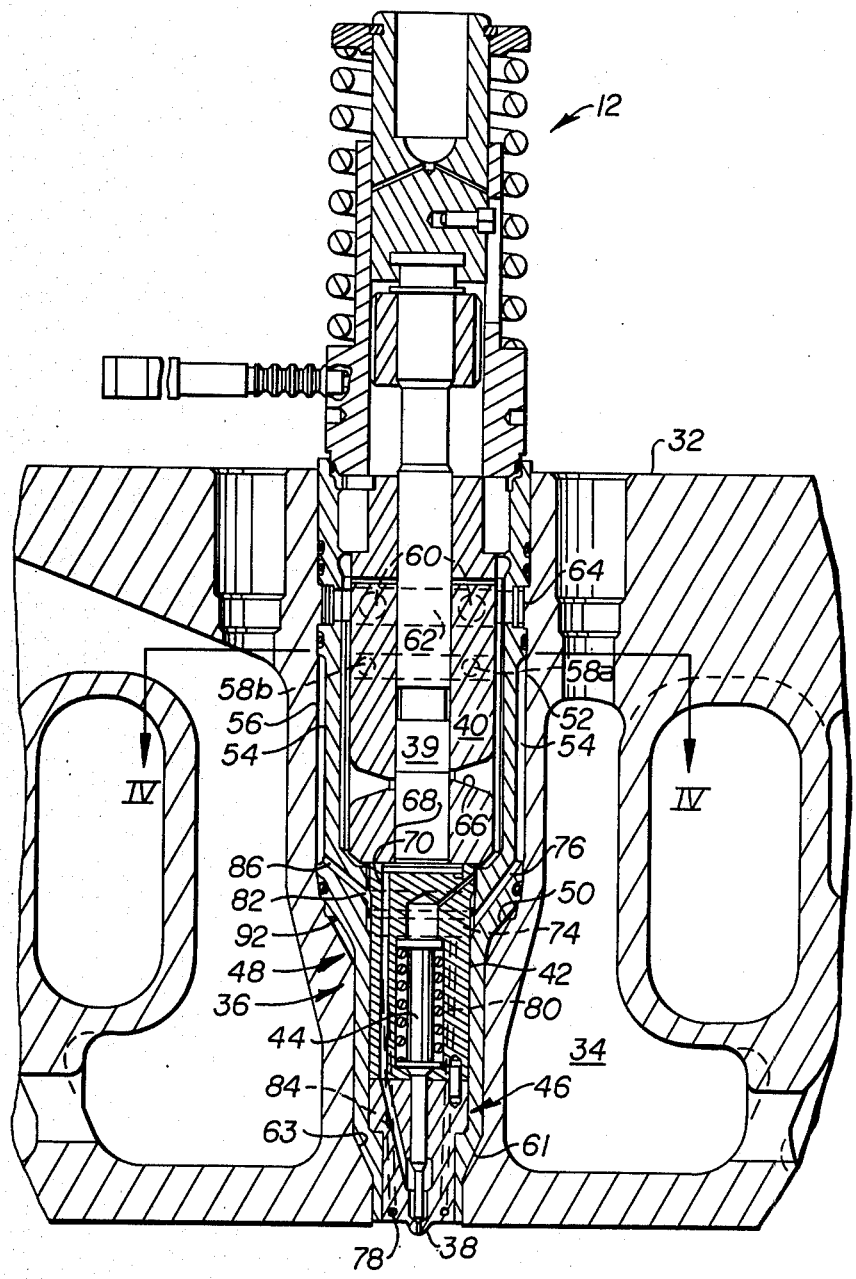
FIG. 3 is a cross-sectional view illustrating an embodiment of the present invention.

In FIG. 3, a cylinder head 32 includes well known cooling passages 34 which are formed in the head. A unit injector 12 is seated in head 32 including a nozzle end 36 terminating at a tip 38 adjacent a cylinder (not shown).

Well known elements of fuel injector 12, such as plunger 39, barrel 40, spring cage 42, lift stop 44 and tip assembly 46, to name a few, are housed in a "retainer" sleeve 48 seated in head 32 at sleeve bore 50. Also, as it is known, means are provided in head 32 for conducting injection fluid to tip 38 of nozzle end 36. Such means includes supply ports 60, annular groove 62, filtered inlets 64, port 66, bore 68 and nozzle bore 70. Groove 62 is positioned to be aligned with ports 60 when tapered abutment 61 of sleeve 48 contacts tapered seat 63.

Means are provided for conducting temperature controlling fluid, whether heated or cooled, toward and away from nozzle end 36. A portion of such means includes, but is not limited to, a circumferential groove 52 and an axial passage 54 formed in outer peripheral surface 56 of retainer sleeve 48 by machining or the like. It is preferred that axial passage 54 include two inlet passages 54*a,b* and two outlet passages 54*c,d* (best shown in FIG. 4).

Groove 52 is positioned to be aligned with inlet-outlet ports 58 (FIG. 4 also) formed in head 32 when tapered abutment 61 of sleeve 48 contacts tapered seat 63. Either of the ports 58 can be an inlet or outlet for a temperature controlling fluid depending on a desired direction of flow. For purposes of this discussion, the inlet will be designated 58*a* and the outlet will be designated 58*b*.

Another portion of the means for conducting temperature controlling fluid toward nozzle end 36 includes passages formed in tip assembly 46, described as follows: the inlet passages 54*a,b* extend from groove 52 to tip inlet annulus 74 via two respective temperature control inlet bores 76 (only one shown) and then to tip temperature control annulus 78 via two tip inlet passages 80 (only one shown). Temperature controlling fluid in tip temperature control annulus 78 is then communicated to tip outlet annulus 82 via two tip outlet passages 84 (only one shown). From annulus 82, temperature control fluid is communicated to outlet passages 54*c,d* via two respective temperature control outlet bores 86 (only one shown).

The use of two of each of the above-described temperature controlling fluid passages permits additional fluid volume to be moved through the injector 12. Single, enlarged passages could be formed as axial bores through retainer sleeve 48 but would require enlarging the overall size of the injector 12. Forming the axial passage 54 in the outer periphery 56 of retainer sleeve 48 permits sleeve 48 to handle added volume of temperature controlling fluid without the need to increase the size of retainer 48 such as by increased wall thickness.

Figure 4:
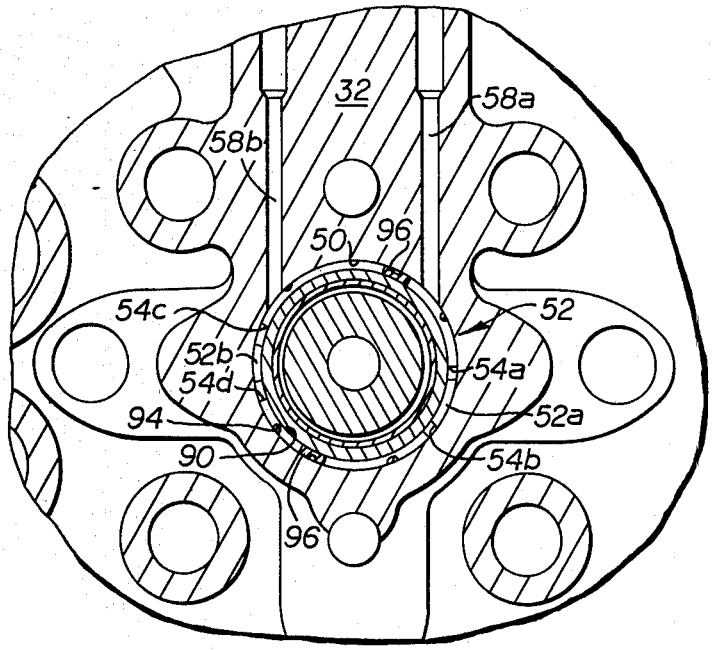
FIG. 4 is a cross-sectional view taken along line IV—IV of FIG. 3 and illustrating the circumferential groove including separating plugs.
Figure 5:
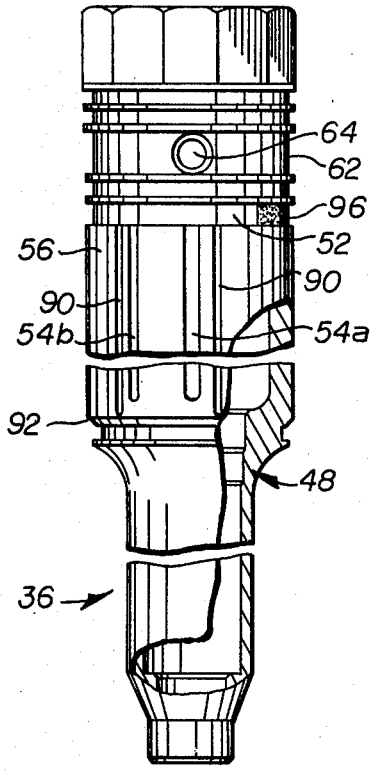
FIG. 5 is a side elevation generally illustrating the present invention.

Means are provided for limiting leakage of temperature controlling fluid from passage 54. Such means comprises axial sealing grooves 90 formed in outer periphery 56 of retainer 48 and are substantially parallel with the axial passage 54 (see FIG. 5). It will be noted that sealing grooves 90 preferably extend from circumferential groove 52 to chamfer 92. Ideally, passages 54*a,b* are each situated between a pair of such sealing grooves 90 as illustrated in FIGS. 4 and 5. A sealing member 94, resistant to fuel contamination, such as one formed of a fluorocarbon rubber, is provided in each groove 90 to seat against sleeve bore 50 of head 32. Clearance between sleeve 48 and bore 50 is approximately 0.008 inches and even without seals 94 only 10% of fuel in passages 54*a,b* was found to bypass to passages 54*c,d*. However, seals 94 are preferred.

Means are provided for separating one portion 52*a* of groove 52 from another portion 52*b*. Such means comprise sealing plugs 96 preferably formed of a fluorocarbon rubber, impervious to deterioration due to fuel contamination, and being squeeze or force fitted into groove 52 to seat against bore 50 and limit mingling of fluid in portion 52*a* with fluid in portion 52*b*.

Industrial Applicability

Temperature controlling fluid, either heated or cooled as above described, is conducted through head 32 via inlet 58*a* to inlet portion 52*a* of groove 52 guarded by sealing plugs 96. Inlet fluid is then conducted via two axial passages 54*a,b* toward nozzle end 36 and then through two inlet bores 76 to annulus 74. Two other inlet passages connect annulus 74 with tip annulus 78. Fluid is carried away from annulus 78 via two outlet passages 84 to outlet annulus 82. From there the fluid is routed through two outlet bores 86, two axial outlet passages 54*c,d* and then confined to outlet portion 52*b* of groove 52 due to sealing plugs 96. The fluid then exits injector 12 through outlet 58*b* formed in head 32.

The foregoing has described a temperature controlled unit fuel injector including a retainer sleeve having a nozzle end and means for moving temperature controlling fluid toward and away from the nozzle end. Increased volumes of temperature controlling fluid are provided to the nozzle end without the need to enlarge the size of the unit fuel injector.

We claim:

1. A unit fuel injector apparatus (12) comprising:

a cylinder head (32) defining a bore (50) and inlet and outlet fluid passages (58*a*,58*b*) connected to the bore (50);

a retainer sleeve (48) having a nozzle end (36), an outer peripheral surface (56), a circumferential groove (52) opening on the surface (56), and first and second axially oriented passages (54*a*,54*c*) opening on the surface (56) and connected to the groove (52); and means (96) for separating one portion (52*a*) of the groove (52) from another portion (52*b*) of the groove (52), the retainer sleeve (48) being releasably connected in the bore (50) and aligning the one portion (52*a*) with the inlet passage (58*a*) and the another portion (52*b*) with the outlet passage (58*b*), the first axially oriented passage (54*a*) communicating temperature controlling fluid from the one portion (52*a*) toward the nozzle end (36), and the second axially oriented passage (54*c*) communicating temperature controlling fluid away from the nozzle end (36) and toward the another portion (52*b*).

2. The apparatus (12) of claim 1 wherein said separating means (96) includes a pair of sealing members force fitted into the groove (52).

3. The apparatus (12) of claim 2 including seal means (90,94) for limiting leakage of the fluid from the axially oriented passages (54*a*,54*c*).

4. The apparatus (12) of claim 3 wherein said seal means (90,94) includes a plurality of axially oriented sealing grooves (90) formed in the retainer sleeve (48) and a sealing member (94) in each of said axially oriented sealing grooves (90).

5. The apparatus (12) of claim 1 wherein the retainer sleeve (48) defines third and fourth axially oriented passages (54*b*,54*d*) opening on the surface (56), the first and third passages (54*a*,54*b*) being connected to the one portion (52*a*) and the second and fourth passages (54*c*,54*d*) being connected to the another portion (52*b*) of the groove (52).

6. The apparatus (12) of claim 1 including:

means (60,62,64,66,68,70) for conducting an injection fluid to the nozzle end (36) of the retainer sleeve (48).

7. The apparatus (12) of claim 1 including:

an element (42);

the retainer sleeve (48) encircling the element (42) and defining first and second bores (76,86) connected to the first and second passages (**54*a*,54*c*) and connected to the element(42**).

8. A unit fuel injector apparatus (12) comprising:

a retainer sleeve (48) including a nozzle end (36);

first means for conducting temperature controlling fluid toward and away from said nozzle end (36), said first means including a circumferential groove (52) connected with an axial passage (54) formed in the outer peripheral surface (56) of said retainer sleeve (48);

second means (96) for separating one portion (**52*a*) of said circumferential groove (52) from another portion (52*b*) of said groove (52); and third means for limiting leakage of said fluid from said axial passage (54), said third means including a plurality of axial sealing grooves (90) formed in the outer periphery (56) of said retainer sleeve (48) and a sealing member (94) in each of said axial sealing grooves (90**).

9. The apparatus (12) of claim 8 wherein the second means (96) includes a pair of sealing members in said circumferential groove (52).

10. The apparatus (12) of claim 8 wherein the second means (96) includes a pair of sealing plugs force fitted into said circumferential groove (52).

* * * * *